US011248413B2

(12) United States Patent
Vaccari

(10) Patent No.: US 11,248,413 B2
(45) Date of Patent: Feb. 15, 2022

(54) PROFILED COMPONENT FOR THE PRODUCTION OF FRAMES

(71) Applicant: Graf Synergy S.r.l., Nonantola (IT)

(72) Inventor: Andrea Vaccari, Nonantola (IT)

(73) Assignee: Graf Synergy S.r.l., Nonantola (IT)

( * ) Notice: Subject to any disclaimer, the term of this patent is extended or adjusted under 35 U.S.C. 154(b) by 32 days.

(21) Appl. No.: 16/621,717

(22) PCT Filed: Jun. 20, 2018

(86) PCT No.: PCT/IB2018/054555
§ 371 (c)(1),
(2) Date: Dec. 12, 2019

(87) PCT Pub. No.: WO2018/235021
PCT Pub. Date: Dec. 27, 2018

(65) Prior Publication Data

US 2021/0140227 A1 May 13, 2021

(30) Foreign Application Priority Data

Jun. 23, 2017 (IT) ..... 102017000070742

(51) Int. Cl.
*E06B 3/54* (2006.01)
*E06B 3/62* (2006.01)

(52) U.S. Cl.
CPC .... *E06B 3/5454* (2013.01); *E06B 2003/6223* (2013.01); *E06B 2003/6252* (2013.01)

(58) Field of Classification Search
CPC ..... E06B 3/5454; E06B 3/62; E06B 3/5821; E06B 2003/6223; E06B 2003/6252;
(Continued)

(56) References Cited

U.S. PATENT DOCUMENTS 4,151,696 A * 5/1979 Knights ..... E06B 3/56 264/261
6,167,662 B1 * 1/2001 Gruber ..... E06B 3/5454 52/204.1

(Continued)

FOREIGN PATENT DOCUMENTS

DE 2630312 A1 * 1/1978 ..... E06B 3/6205
DE 2755930 6/1978

(Continued)

OTHER PUBLICATIONS

International Search Report and the Written Opinion dated Oct. 16, 2018 From the International Searching Authority Re. Application No. PCT/IB2018/054555. (8 Pages).

*Primary Examiner* — Ryan D Kwiecinski

(57) ABSTRACT

The profiled component (1) for the production of frames comprises:

a profiled element (2) comprising a longitudinal channel (3) adapted to at least partly contain a substantially sheet-shaped panel (4) and to surround at least partly, the longitudinal channel (3) defining a coupling plane (5) for the insertion of the panel (4) inside the profiled element (2);

two seal elements (6) adapted to hermetically seal the longitudinal channel (3), associated with the profiled element (2) by means of connection means (7) and comprising a first corner (8) adapted to hermetically adhere onto the panel (4);

wherein the seal element (6) comprises a lever edge (28) which is shaped to come into contact with the panel (4) during the insertion of the panel (4) inside the longitudinal channel (3) to displace the seal element (6) between:

a home configuration, wherein the panel (4) is outside the longitudinal channel (3) and the first corner (8) is moved away from the coupling plane (5); and (Continued)

a coupling configuration, wherein the panel (4) is inside the longitudinal channel (3) and the first corner (8) is approached to the coupling plane (5) and pressed to adhere hermetically to the panel (4).

10 Claims, 7 Drawing Sheets

(58) Field of Classification Search
CPC ..... E06B 2003/5463; E06B 2003/6232; E06B 2003/6229
USPC ..... 52/204.591, 204.53, 204.66
See application file for complete search history.

(56) References Cited

U.S. PATENT DOCUMENTS 6,202,353 B1 * 3/2001 Giacomelli ..... E06B 3/2632 49/504
6,216,401 B1 * 4/2001 Emek ..... E06B 1/6046 49/322

FOREIGN PATENT DOCUMENTS

| | | | | | |
|---|---|---|---|---|---|
| FR | 2993304 | A1 * | 1/2014 | ..... | E06B 3/16 |
| GB | 2118233 | A * | 10/1983 | ..... | E06B 3/62 |
| WO | WO-2009033550 | A1 * | 3/2009 | ..... | E06B 3/6205 |
| WO | WO 2018/235021 | | 12/2018 | | |
| WO | WO-2018235021 | A * | 12/2018 | ..... | E06B 3/5454 |

* cited by examiner

PROFILED COMPONENT FOR THE PRODUCTION OF FRAMES

RELATED APPLICATIONS

This application is a National Phase of PCT Patent Application No. PCT/IB2018/054555 having International filing date of Jun. 20, 2018, which claims the benefit of priority of Italian Patent Application No. 102017000070742 filed on Jun. 23, 2017. The contents of the above applications are all incorporated by reference as if fully set forth herein in their entirety.

FIELD AND BACKGROUND OF THE INVENTION

The present invention relates to a profiled component for the production of frames.

With particular, but not exclusive, reference to the building sector, the use is known of profiled components for the production of frames intended to close an opening, such as, e.g., a window or a door in a building.

Generally speaking, the profiled components are manufactured by means of a process of extrusion of metal, plastic or similar materials, which makes it possible to produce profiled components of different cross-sections and sizes depending on the mold used.

The profiled components made using this method must be shaped, cut and finally welded together to create frames of different shapes, of both the movable (e.g. the leaf of a window) or fixed (e.g. stably fixed to a wall) type.

Generally, once the profiled components are welded together, the frame surround is obtained, which is then completed by applying an inner panel, e.g., made of glass or Plexiglas to mount a window or made of another material adapted to actively close the opening.

More specifically, the inner panel is fitted manually by an operator inside the previously welded surround.

The same operator then locks the inner panel with retaining boards or glazing beads, which are coupled to the profiled components of the surround and pressed against the inner panel.

When fixing the glazing beads, the operator also positions a seal between the inner panel and the glazing beads.

At the end of the operation, the glazing beads are an integral part of the frame and the seals are under pressure on the inner panel to ensure the tightness thereof.

However, the operation of fitting the inner panel to the surround has considerable drawbacks due to its complexity and costs.

The patent document WO2017072660 shows a process for the manufacture of frames and frameworks that makes it possible to overcome these problems.

In the process shown in the patent document WO2017072660, each profiled component has a substantially C-shaped cross section and comprises a housing seat into which a perimeter portion of the inner panel is fitted.

More specifically, the profiled components made this way are welded together when the respective housing seats frame the inner panel to form the complete frame without the need for the use of retaining boards or glazing beads.

Furthermore, the housing seat of the profiled component is provided with seals adapted to press against the inner panel and prevent direct rubbing between the inner panel and the walls of the profiled component.

The seals keep the interlock between the inner panel and the profiled component stable and protect the frame from the build-up of dirt, such as e.g. liquids and dust.

In fact, water infiltrations inside the indentures created between the inner panel and the profiled component lead to the proliferation of molds and bacteria which cause allergies and/or diseases, as well as having a remarkably ugly appearance.

Generally, known profiled components have imperfections due to the high temperatures reached by the material during the extrusion process, so that the housing seat of the profiled component does not always fit perfectly around the inner panel.

For this reason, the side walls of the housing seat of the profiled components shown in patent document WO2017072660 are substantially inclined towards each other to ensure that the seals adhere strongly to the faces of the inner panel after its insertion inside the profiled component.

However, this type of profiled component is susceptible to improvement tied to the mechanism of adhesion of the seals to the inner panel.

In fact, in order to be able to insert the inner panel inside the profiled components, the side walls of the housing seat must be inconveniently divaricated.

This operation is not always easy to carry out and must be performed on all the profiled components used to make the frame with a consequent increase in the costs of fitting and installation, which inevitably affect the retail price, with the risk of making the products less appealing to customers.

Furthermore, the seals are generally curved in shape and form a sort of support step that collects dirt in contact along the faces of the inner panel and along the side walls of the profiled component.

SUMMARY OF THE INVENTION

The main aim of the present invention is to provide a profiled component for the production of frames which makes it possible to simplify and speed up the operations of insertion of the inner panel inside the housing seat of the profiled component.

Another object of the present invention is to make a profiled component for the production of frames which allows simplifying the application of the seal between the profiled component and the inner panel.

Last but not least object of the present invention is to make a profiled component for the production of frames which simplifies and speeds up the frame production process.

Another object of the present invention is to provide a profiled component for the production of frames which allows overcoming the aforementioned drawbacks of the prior art within the scope of a simple, rational, easy, efficient to use and cost-effective solution.

The aforementioned objects are achieved by the present profiled component for the production of frames having the characteristics of claim 1.

BRIEF DESCRIPTION OF THE SEVERAL VIEWS OF THE DRAWINGS

Other characteristics and advantages of the present invention will become more evident from the description of a preferred, but not exclusive embodiment of a profiled component for the production of frames, illustrated by way of an indicative, but non-limiting example, in the attached drawings in which.

DESCRIPTION OF SPECIFIC EMBODIMENTS OF THE INVENTION

Figure 1:
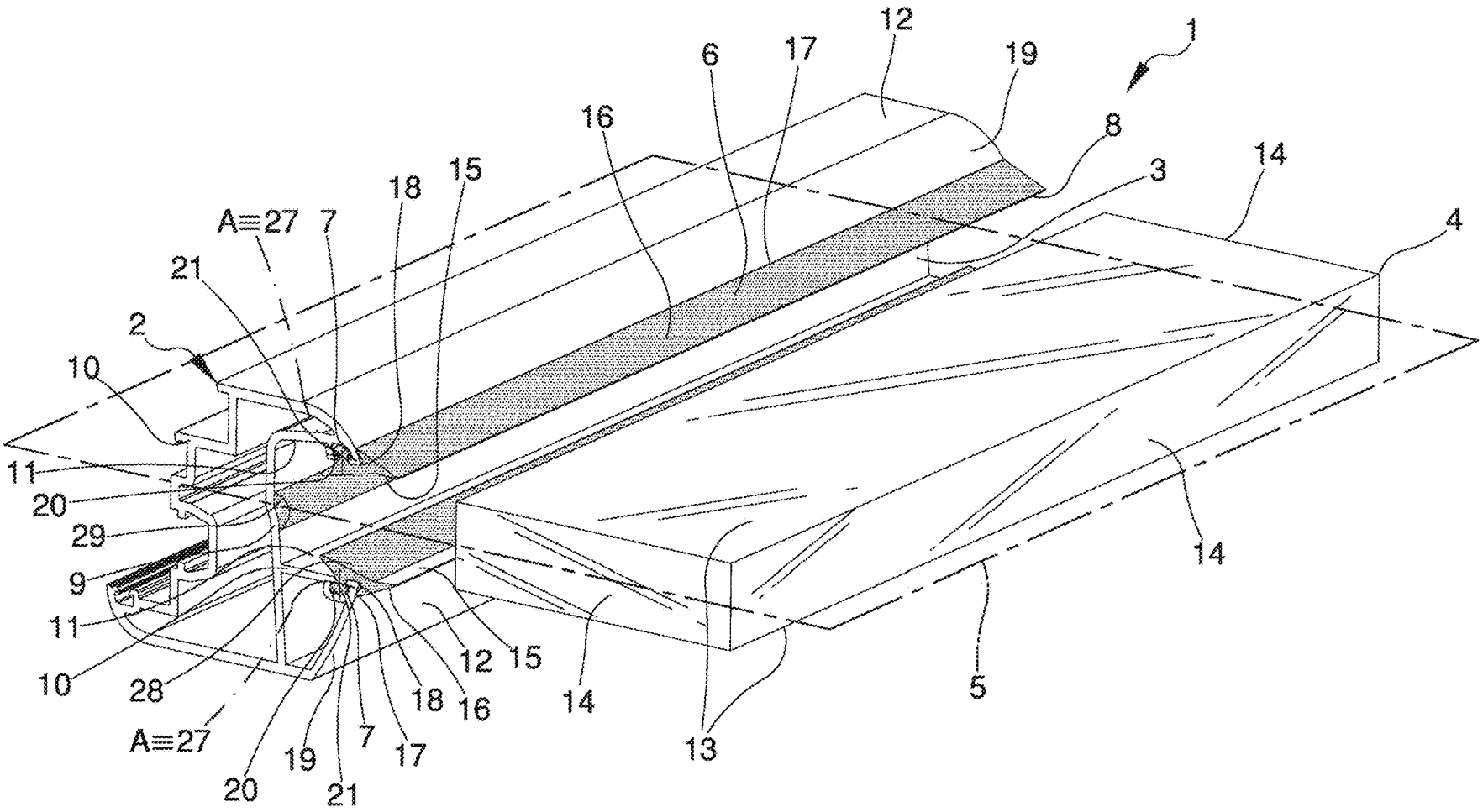
FIG. 1 is an axonometric view of a first embodiment of the profiled component according to the invention in an initial configuration.
Figure 2:
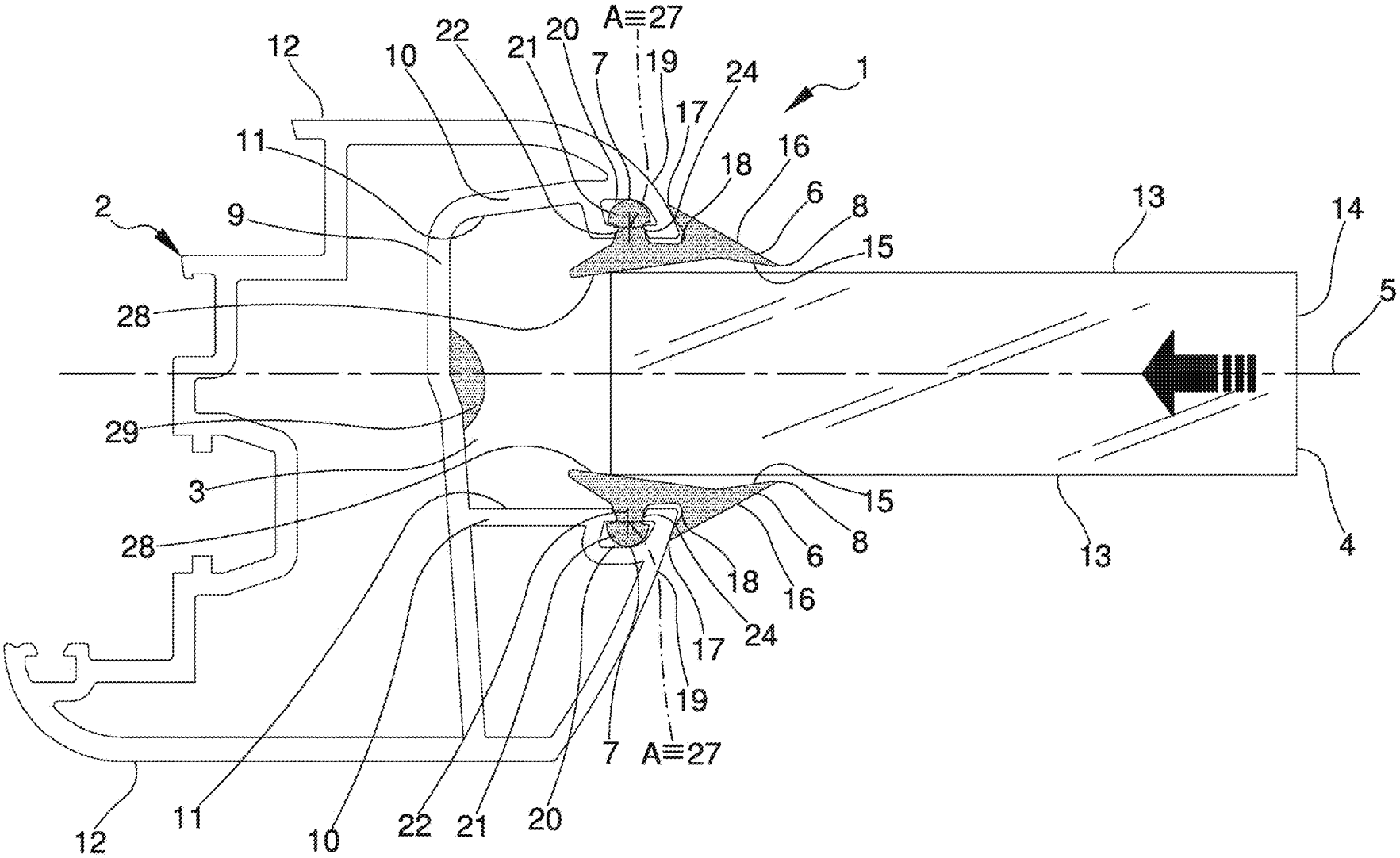
FIG. 2 is a cross-sectional view of the profiled component of FIG. 1 in an intermediate configuration.
Figure 3:
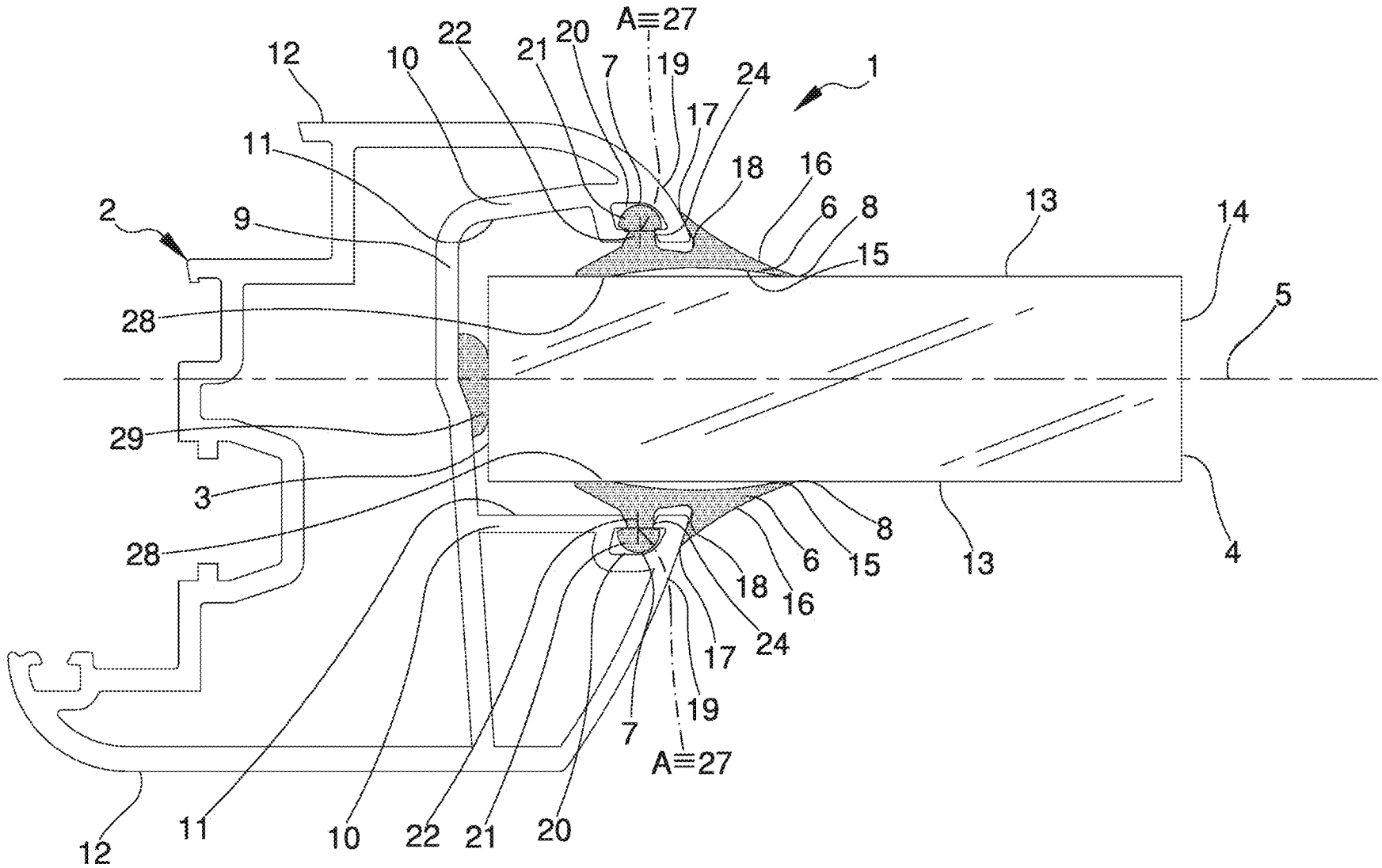
FIG. 3 is a cross-sectional view of the profiled component of FIG. 1 in a final configuration.

With particular reference to these illustrations, reference numeral 1 globally indicates a profiled component for the production of frames.

The profiled component 1 comprises:

at least one profiled element 2 comprising at least one longitudinal channel 3 adapted to at least partly contain a substantially sheet-shaped panel 4 and to surround at least partly the longitudinal channel 3 defining a coupling plane 5 for the insertion of the panel 4 inside the profiled element 2;

at least one seal element 6 adapted to hermetically seal the longitudinal channel 3, associated with the profiled element 2 by means of connection means 7 and comprising at least a first corner 8 adapted to hermetically adhere onto the panel 4.

Within the scope of the present treatise, the term "longitudinal" referred to the profiled element 2 indicates the direction in which the profiled element 2 extends in length; since such profiled element 2 is usually made by extrusion of the plastic material, then the longitudinal direction coincides with the extrusion direction.

The profiled element 2 is made, e.g., of PVC, but heat-sealable plastics other than PVC cannot be ruled out.

Alternatively, the profiled element 2 is made of metal materials such as aluminum.

However, alternative embodiments cannot be ruled out wherein the profiled element 2 is partly made of plastic and partly of a different material, in a way similar to certain materials of a known type which, e.g., have a jacket, an external covering or an internal core made of metal, wood or the like.

The profiled element 2 comprises at least one base longitudinal section 9 and a pair of lateral longitudinal sections 10 arranged substantially in a "C" pattern the one to the other, with the pair of lateral longitudinal sections 10 extending from the base longitudinal section 9 and together defining the longitudinal channel 3.

Each of the lateral longitudinal sections 10 comprises an inner face 11 facing the inside of the longitudinal channel 3 and an outer face 12 facing the outside of the longitudinal channel 3 substantially opposite the inner face 11.

Advantageously, the profiled element 2 comprises two identical seal elements 6, each associated with the corresponding inner face 11 of a lateral longitudinal section 10 and arranged substantially opposite each other inside the longitudinal channel 3.

In the remainder of the present treatise, reference is made without distinction to a seal element 6 and to a lateral longitudinal section 10, or to two seal elements 6 and to two lateral longitudinal sections 10.

In fact, what is described and shown for a seal element 6 and for the relative lateral longitudinal section 10 is to be deemed valid for all the seal elements 6 and all the lateral longitudinal sections 10 present in the profiled component 1.

With particular reference to the embodiment shown in the Figures from 1 to 3, the base longitudinal section 9 and the pair of lateral longitudinal sections 10 can be made in a single monolithic body, i.e. extruded through a shaped mold which directly impresses the "C" shape to the profiled element 2.

Figure 4:
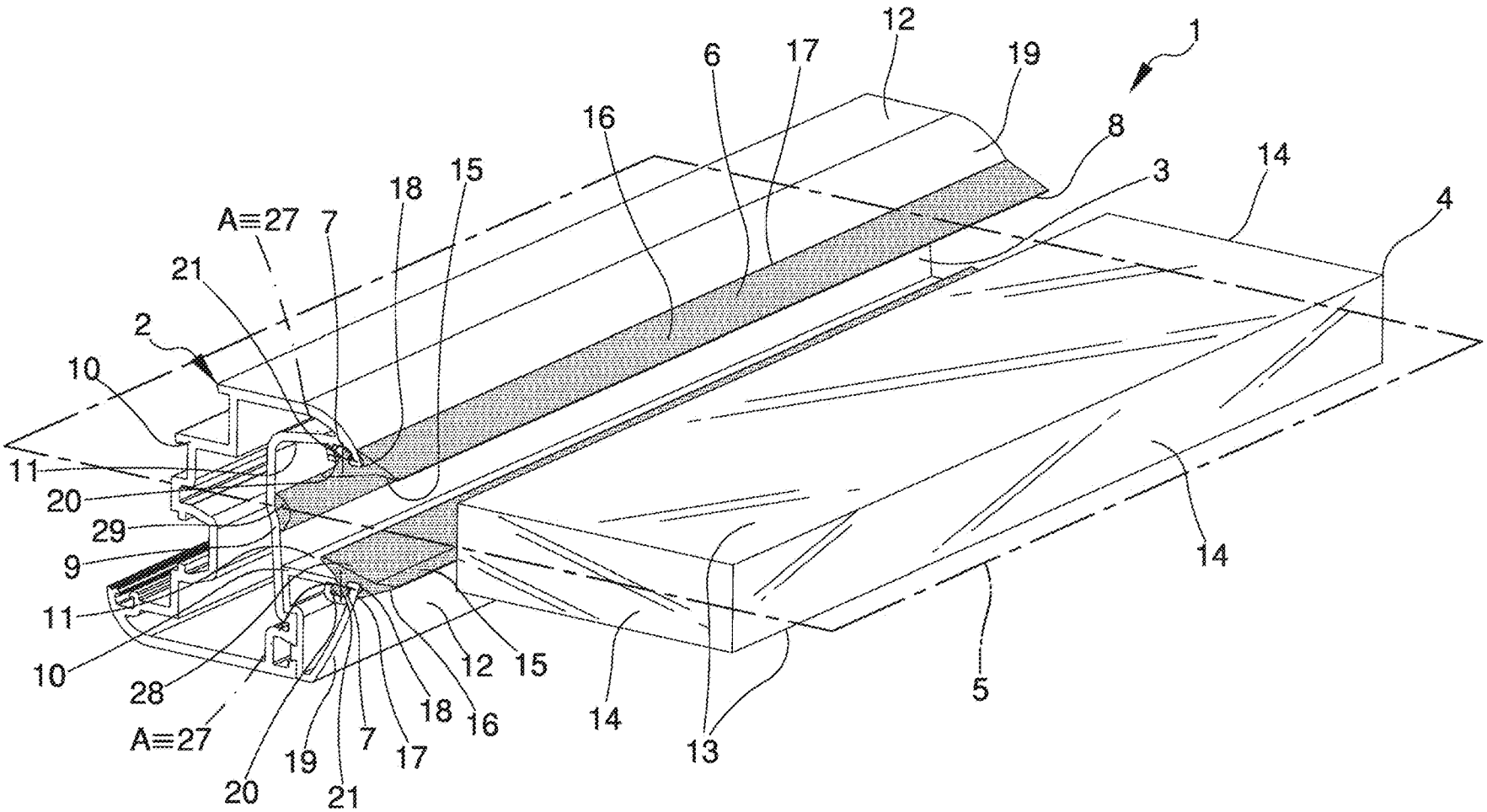
FIG. 4 is an axonometric view of a second embodiment of the profiled component according to the invention.

In an alternative embodiment shown in FIG. 4, on the other hand, the base longitudinal section 9 and the lateral longitudinal sections 10 can be made separately and subsequently assembled; the base longitudinal section 9 and one of the lateral longitudinal sections 10, for example, can be extruded together to form a single monolithic substantially L-shaped body, while the other lateral longitudinal section 10 is extruded separately and is associated (e.g. by interlocking) with the base longitudinal section 9 after extrusion.

In both the cases described above, the profiled element 2 is made with a cross-section substantially identical in shape along its entire length and substantially identical to the shape of the extrusion mold used.

The coupling plane 5 is defined as substantially parallel to the lateral longitudinal sections 10 and passing through the centre of the base longitudinal section 9 to define the plane along which the panel 4 is inserted inside the longitudinal channel 3.

The panel 4 is advantageously made of glass (single layer or multilayer) but its being made of Plexiglas or other material, both transparent and non-transparent cannot be ruled out.

The panel 4 comprises at least one front face 13 and a plurality of perimeter faces 14.

Preferably, the panel 4 comprises two front faces 13 of identical rectangular shape and arranged substantially parallel and opposite each other and four perimeter faces 14 of identical rectangular shape, substantially smaller in size with respect to the front faces 13 and arranged at 90° to each other and between the front faces 13 to form a flat slab.

This way, the section of the panel 4 is made with a substantially rectangular shape; however, alternative embodiments cannot be ruled out wherein the panel 4 is shaped in a different way, e.g., comprising two front faces 13 with a substantially triangular shape and three perimeter faces 14 to make the panel 4 with a substantially triangular shape.

Furthermore, the distance between the front faces 13 of the panel 4 is substantially identical to the distance between the inner faces 11 of the lateral longitudinal sections 10 of the profiled element 2 to allow the panel 4 to be inserted inside the longitudinal channel 3.

Advantageously, the seal element 6 is an elongated body which extends longitudinally along the entire length of the profiled element 2.

Like the profiled element 2, the seal element 6 has a cross-section which is substantially identical in shape along its entire length.

Furthermore, the seal element 6 is made of rubber.

The seal element 6 comprises a lever edge 28 which is shaped to come into contact with the panel 4 during the insertion of the panel 4 inside the longitudinal channel 3 to displace the seal element 6 between:

at least one home configuration, wherein the panel 4 is outside the longitudinal channel 3 and the first corner 8 is moved away from the coupling plane 5; and at least one coupling configuration, wherein the panel 4 is inside the longitudinal channel 3 and the first corner 8 is approached to the coupling plane 5 and pressed to adhere hermetically to the panel 4.

In the remainder of this treatise, the term "edge" referred to the seal element 6 intends indicating a flat longitudinal face with an essentially rectangular shape extending substantially along the entire length of the seal element 6.

Similarly, the term "corner" referred to the seal element 6 indicates the region of junction of two longitudinal faces of the seal element 6.

More specifically, the cross section of any edge and of any corner has the shape of a straight line and a point respectively.

The seal element 6 also comprises a stop edge 15 and an outer edge 16 contiguous with the stop edge 15 along the first corner 8.

Advantageously, the internal angle formed by the stop edge 15 and by the outer edge 16 is of the acute type to form a particularly thin extreme portion of the seal element 6, the terminal tip of which coincides with the first corner 8.

The stop edge 15 is also contiguous with the lever edge 28 with which it defines a concave surface arranged substantially opposite the coupling plane 5 and with the concavity substantially facing the coupling plane 5.

Furthermore, the internal angle formed by the stop edge 15 and by the lever edge 28 is of the obtuse type and less than 180°.

More specifically, the lever edge 28 is substantially located inside the longitudinal channel 3, while the stop edge 15 is substantially located outside the longitudinal channel 3.

Furthermore, the seal element 6 comprises at least a second corner 17 adapted to adhere hermetically onto the profiled element 2 in the coupling configuration. The second corner 17 is arranged substantially opposite the first corner 8 with respect to the outer edge 16 and rests on the outer face 12 of the lateral longitudinal section 10 of the profiled element 2.

More specifically, the seal element 6 also comprises a curved section 18 contiguous with the outer edge 16 along the second corner 17 and located substantially astride the lateral longitudinal section 10.

This way, the seal element 6 is located with the first corner 8 and the second corner 17 located substantially outside the longitudinal channel 3.

More specifically, the profiled element 2 comprises at least one outer superficial portion 19 of substantially arched shape, the second corner 17 gliding tight to the outer superficial portion 19 during the displacement of the seal element 6 between the home configuration and the coupling configuration.

The outer superficial portion 19 is obtained on the outer face 12 of the lateral longitudinal section 10 of the profiled element 2 in the proximity of the longitudinal channel 3, while on the inner face 11 of the lateral longitudinal section 10 are obtained the connection means 7 to associate the seal element 6 with the profiled element 2.

In the particular embodiments shown in the illustrations, the connection means 7 comprise at least one cavity 20 formed between at least one of the profiled element 2 and the seal element 6 and at least one interlocking portion 21 formed on the other of the profiled element 2 and the seal element 6 and inserted interlocked in the cavity 20.

Advantageously, the cavity 20 is longitudinally obtained along the entire length of the inner face 11 of the lateral longitudinal section 10 and extends substantially parallel to the coupling plane 5, while the interlocking portion 21 is obtained longitudinally along the entire length of the seal element 6 arranged substantially opposite the lever edge 28.

This way, the seal element 6 is longitudinally associated inside the longitudinal channel 3 along the entire length of the profiled element 2.

The seal element 6 comprises at least a weakened portion 22 associated with the connection means 7, the weakened portion 22 being deformable to allow the displacement of the seal element 6 between the home configuration and the coupling configuration.

More specifically, the weakened portion 22 extends longitudinally along the entire body of the seal element 6 and has a section substantially reduced in size with respect to the interlocking portion 21 interlocked inside the lateral longitudinal section 10.

In fact, the lateral longitudinal section 10 comprises two longitudinal fastening sections located on the inner face 11, facing the cavity 20 and substantially parallel to the coupling plane 5.

More specifically, the two longitudinal fastening sections extend one towards the other to close at least partly the cavity 20 and to define an inlet opening 24 for the insertion of the interlocking portion 21 inside the cavity 20.

Furthermore, the interlocking portion 21 is substantially larger than the inlet opening 24 and comprises an enlarged body and two longitudinal stop sections adapted to abut with the longitudinal fastening sections and interposed between the enlarged body and the weakened portion 22.

In fact, the enlarged body deforms to cross the inlet opening 24 and to position itself inside the cavity 20 together with the longitudinal stop sections which, this way, abut with the longitudinal fastening sections and fix the interlocking portion 21 inside the cavity 20.

Consequently, as mentioned above, the weakened portion 22 is fixed through the inlet opening 24 to allow the movement of the seal element 6 between the home configuration and the coupling configuration.

Furthermore, the seal element 6 comprises at least one axis of rotation A substantially parallel to the coupling plane 5 and located between the lever edge 28 and the first corner 8, the axis of rotation A coinciding with a fulcrum 27 around which at least part of the seal element 6 rotates between the home configuration and the coupling configuration.

Advantageously, the axis of rotation A is centered longitudinally along the extension of the weakened portion 22, which deforms resulting in the above rotation.

Alternatively or in combination with the interlocking made by the cavity 20 and by the interlocking portion 21, the connection means 7 comprise at least one adhesive layer positioned between the seal element 6 and the profiled element 2.

Advantageously, the adhesive layer is applied to the inner face 11 of the lateral longitudinal section 10 between the cavity 20 and the interlocking portion 21.

Alternative embodiments cannot however be ruled out wherein the adhesive layer is applied directly between the weakened portion 22 of the seal element 6 and the inner face 11 of the profiled element 2.

Furthermore, alternatively to the adhesive layer, the connection means 7 comprise at least a first extruded portion of the profiled element 2 and at least a second extruded portion of the seal element 6, the first extruded portion and the second extruded portion being melted at least partly to each other.

In particular, the material for the extrusion of the profiled element 2 and the material for the extrusion of the seal element 6 are extruded together through a co-extrusion process.

The co-extrusion process allows the extruded materials to exit the extrusion mold coupled; this way, the profiled element 2 and the seal element 6 are made in a single monolithic body and each retain the physical properties of the respective materials they are made of.

The profiled component 1 comprises at least one shock absorber component 29 associated with the profiled element 2 inside the longitudinal channel 3 and adapted to receive and support the panel 4 inside the longitudinal channel 3 in the coupling configuration.

The shock absorber component 29 has a substantially crescent-shaped cross-section, is longitudinally associated with the base longitudinal section 9 and extends substantially along the entire length of the profiled element 2.

Advantageously, the shock absorber component 29 is made of rubber.

The operation of the embodiments shown in figures from 1 to 4 is as follows.

From the home configuration, the panel 4 is brought closer to the profiled element 2 to insert inside the longitudinal channel 3 along the coupling plane 5 with one of the perimeter faces 14 facing substantially parallel and opposite the base longitudinal section 9.

During the entry of the panel 4 inside the longitudinal channel 3, the perimeter face 14 and, more precisely, its corners contiguous to the front faces 13 come into contact with the seal elements 6 by pressing on the corresponding lever edges 28.

This pressure exerted by the panel 4 results in a force applied to the lever edges 28 and which sets a lever mechanism in motion.

In fact, the lever edge 28 and the stop edge 15 are substantially the two arms of the lever mechanism which has as its fulcrum the fulcrum 27 and in this case coincides with the axis of rotation A.

This way, the panel 4 rotates the lever edge 28 around the axis of rotation A away from the coupling plane 5.

As a result, the stop edge 15 also rotates around the axis of rotation A, but approaching the coupling plane 5 and brings the first corner 8 into contact with the front face 13 of the panel 4.

At the same time, the outer edge 16 also rotates around the axis of rotation A, approaching the coupling plane 5 and drags with it the second corner 17, causing it to glide along the outer superficial portion 19 of the outer face 12.

The panel 4 is pushed inside the longitudinal channel 3 until it presses with the perimeter face 14 against the shock absorber component 29.

Having reached this position, the seal element 6 is rotated, the stop edge 15 and the lever edge 28 are pressed in contact against the front face 13 of the panel 4 by the panel 4 itself and the second corner 17 is pressed in contact against the outer superficial portion 19.

This way, the longitudinal channel 3 of the profiled element 2 is hermetically sealed.

In fact, the outer edge 16 of the seal element 6 is arranged outside the longitudinal channel 3 and is inclined starting from the first corner 8 pressed in contact against the panel 4 until it reaches the second corner 17 pressed in contact against the profiled element 2.

More specifically, the connection between the panel 4, the seal element 6 and the profiled element 2, made this way, defines an outer profile with a substantially decreasing inclination starting from the front face 13 and continuing with the outer edge 16 and ending with the outer superficial portion 19.

Figure 5:
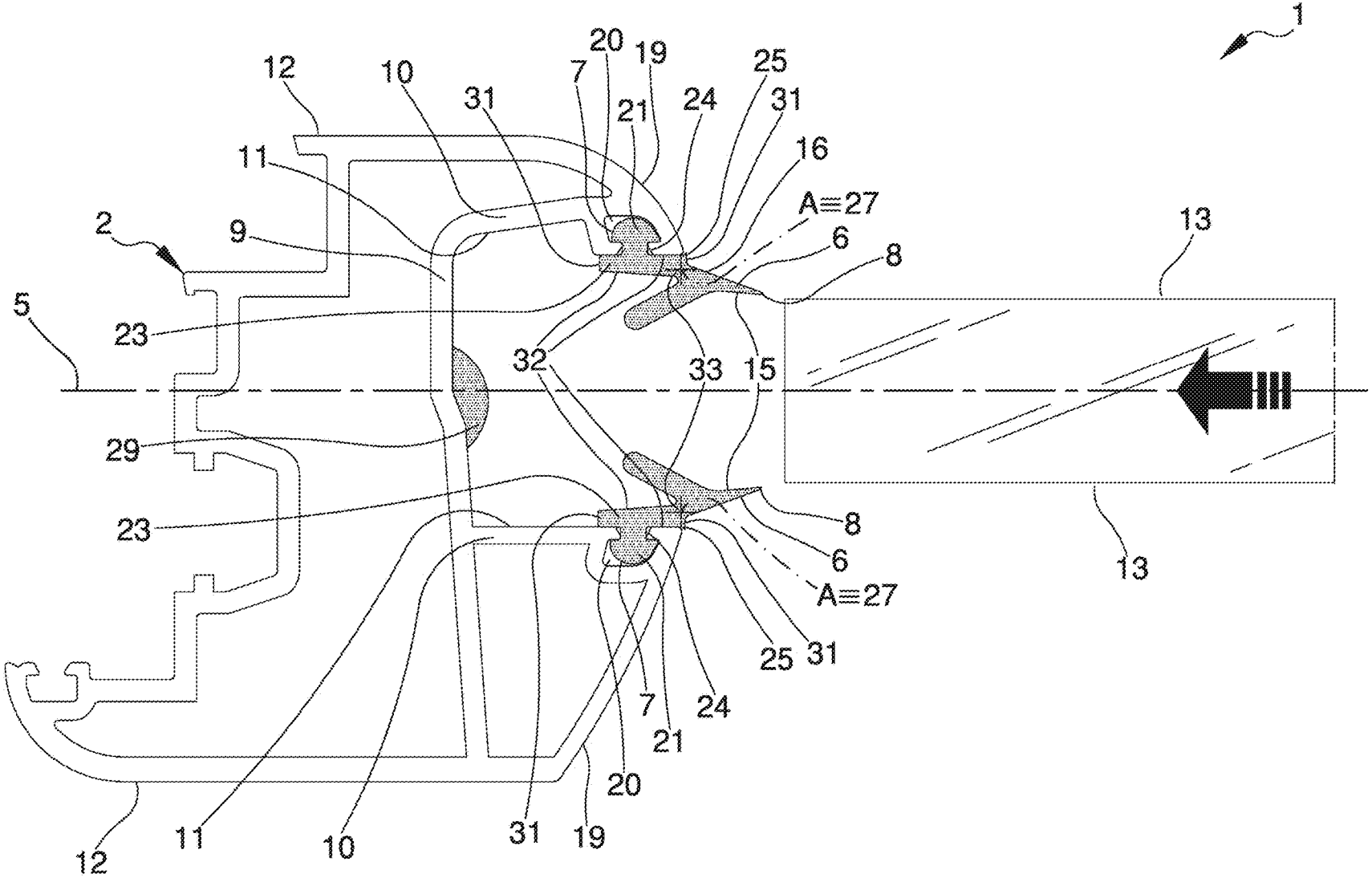
FIG. 5 is a cross-sectional view of a third embodiment of the profiled component according to the invention in an initial configuration.
Figure 6:
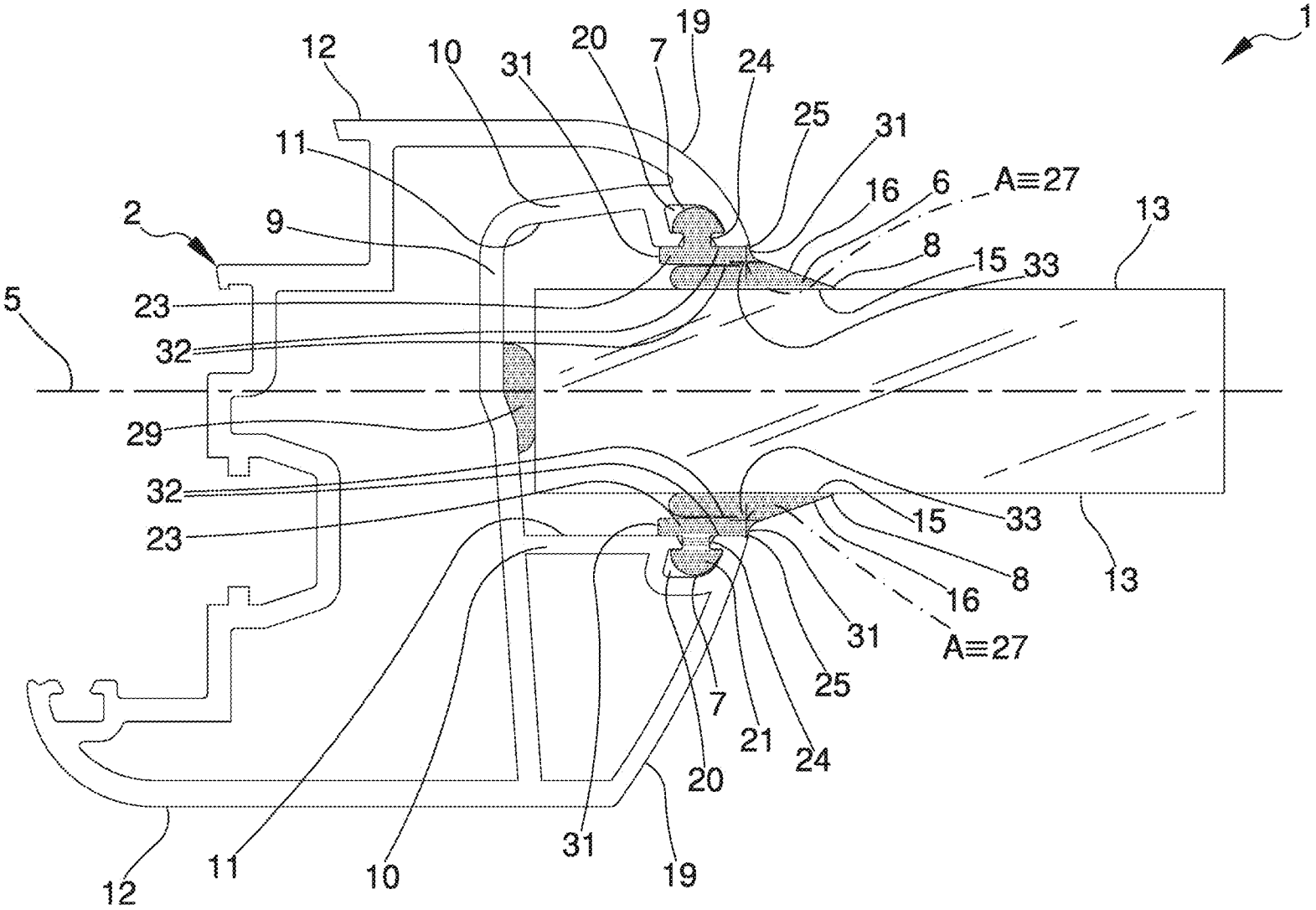
FIG. 6 is a cross-sectional view of the profiled component of FIG. 5 in a final configuration.
Figure 7:
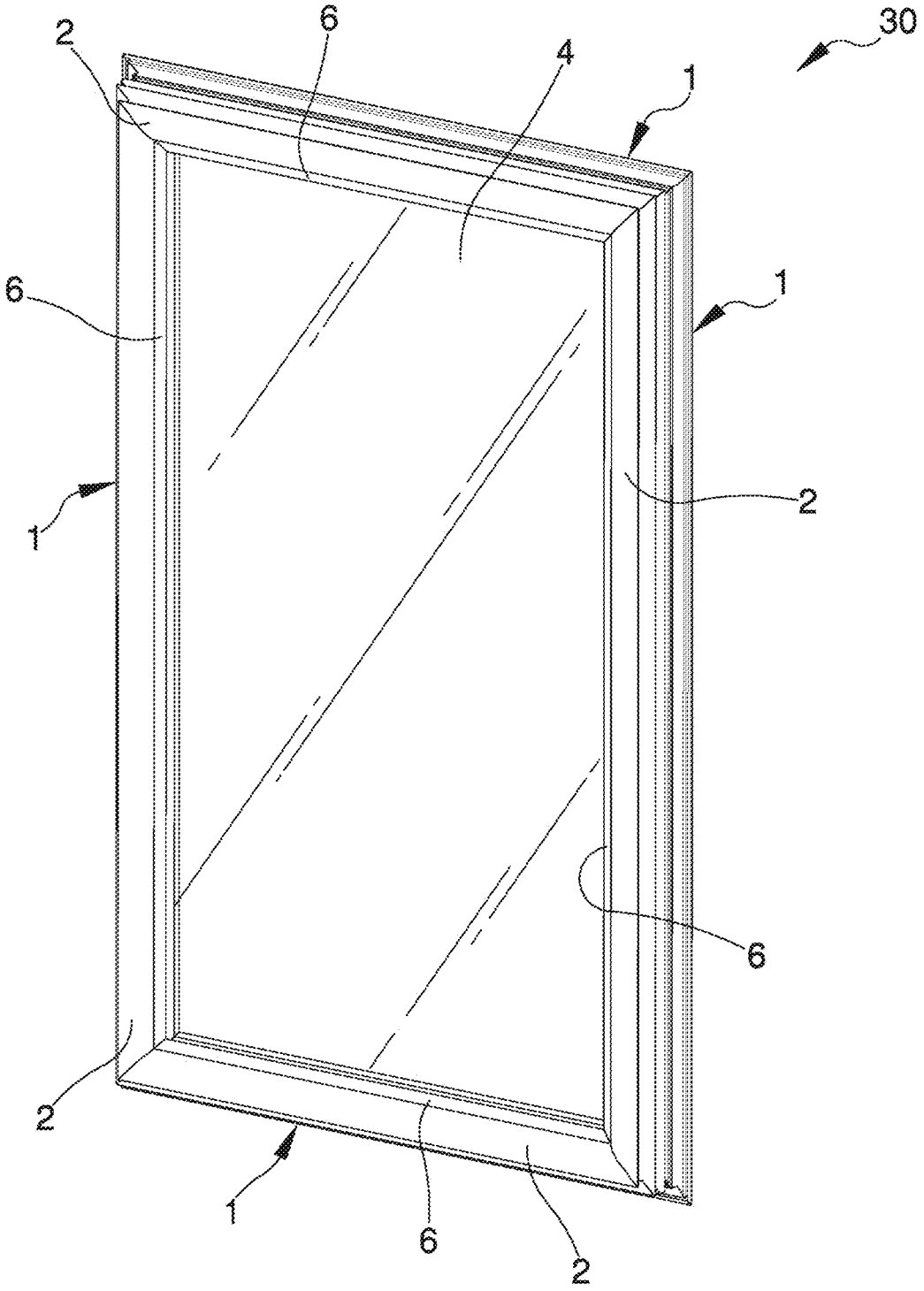
FIG. 7 is an axonometric view of a frame made of a plurality of profiled components according to the invention.

An alternative embodiment of the profiled component 1 is shown in the FIGS. 5 and 6 and is obtained through a number of modifications to the seal element 6 shown in the figures from 1 to 4 including, in particular, the removal of the second corner 17.

Furthermore, the seal element 6 shown in the FIGS. 5 and 6 comprises at least one sealing portion 23 associated with the connection means 7, the sealing portion 23 being deformable to seal at least partly the longitudinal channel 3 when the seal element 6 is in the coupling configuration.

The sealing portion 23 is substantially a longitudinal section with a substantially rectangular section interposed between the connection means 7 and the portion of the seal element 6 comprising the first corner 8, the stop edge 15, the outer edge 16 and the lever edge 28.

More specifically, the sealing portion 23 comprises two pressure edges 32 substantially parallel and opposite each other and two sealing edges 31 substantially parallel and opposite each other and contiguous to the pressure edges 32 to form the rectangular section of the sealing portion 23.

Advantageously, one of the pressure edges 32 is associated with the connection means 7 and is facing in contact with a lateral longitudinal section 10.

This way, the sealing portion 23 is arranged inside the longitudinal channel 3, while the first corner 8 is arranged substantially outside the longitudinal channel 3 and the lever edge 28 is arranged substantially inside the longitudinal channel 3, similarly to what was described for the first embodiment.

In fact, in this second embodiment, the outer edge 16 and the lever edge 28 are associated with the sealing portion 23 through a curved longitudinal section 33 associated substantially at the corner formed between a pressure edge 32 and a sealing edge 31 of the sealing portion 23.

Furthermore, the axis of rotation A, coinciding with the fulcrum 27, is located longitudinally along the curved longitudinal section 33 so as to allow the rotation of the seal element 6, due to the deformation of the material, similarly to what was described with regard to the embodiments shown in the Figures from 1 to 4.

The sealing portion 23 comprises at least one protrusion 25, the protrusion 25 winding at least partly the profiled element 2 outside the longitudinal channel 3 when the seal element 6 is in the coupling configuration.

The protrusion 25 is substantially an extension of the body of the sealing portion 23 substantially opposite the curved longitudinal section 33.

More specifically, the protrusion 25 is substantially contiguous to the sealing edge 31 facing outside the longitudinal channel 3 and extends outside the latter in contact with the body of the profiled element 2 to cover the region where the lateral longitudinal section 10 of the longitudinal channel 3 and the pressure edge 32 of the sealing portion 23 interface.

The operation of the invention in the embodiment of the FIGS. 5 and 6 is distinguished from the embodiments of the Figures from 1 to 4 by the fact that in the coupling configuration the lever edge 28 is pressed by the panel 4 against a pressure edge 32 of the sealing portion 23, which in turn is pressed against the lateral longitudinal section 10 of the longitudinal channel 3.

This way, the first corner 8 seals the interface between the panel 4 and the seal element 6, similarly to what was described with regard to the embodiments shown in the Figures from 1 to 4, while the interface between the profiled element 2 and the seal element 6 is sealed by means of the sealing portion 23.

The profiled component 1 made in one of the described embodiments can be processed according to the process shown in the patent document WO2017072660 in order to make a frame 30.

The frame 30 comprises:

the panel 4; and a plurality of profiled components 1.

The panel 4 is surrounded at least partly by the profiled components 1, with the seal elements 6 of the profiled components 1 which are in the coupling configuration.

Furthermore, because the panel 4 is rectangular, four profiled components 1 are provided, one for each perimeter face 14; it is easy to appreciate however that if the panel 4 is triangular, three profiled components 1 are used, if the panel 4 is pentagonal, five profiled components 1 are used, and so on.

It has in practice been ascertained how the described invention achieves the intended objects.

In particular, it is underscored that the lever mechanism makes it possible to significantly reduce the time needed to surround the panel with the profiled components.

In fact, the clamping of the longitudinal channel by means of the seal element takes place automatically by means of the operation of inserting the panel inside each profiled component.

Furthermore, the arrangement of the first corner, second corner and outer edge in the coupling configuration makes it possible to avoid infiltrations, to tighten the longitudinal channel hermetically and at the same time to form a beveled surface with the panel and the profiled element to prevent the formation of dirt accumulation points.

What is more, the operations for the production of frames are simplified without the need for additional steps such as divaricating the walls of the profiled component or using a glazing bead to fix the panel to the profiled component.

What is claimed is:

1. Profiled component (1) for the production of frames, comprising:

at least one profiled element (2) comprising at least one longitudinal channel (3) adapted to at least partly contain a substantially sheet-shaped panel (4) and to surround at least partly, said longitudinal channel (3) defining a coupling plane (5) for the insertion of said panel (4) inside said profiled element (2);

at least one seal element (6) adapted to hermetically seal said longitudinal channel (3), associated with said profiled element (2) by means of connection means (7) and comprising at least a first corner (8) adapted to hermetically adhere onto said panel (4);

wherein said seal element (6) comprises a lever edge (28) which is shaped to come into contact with said panel (4) during the insertion of said panel (4) inside said longitudinal channel (3) to displace said seal element (6) between:

at least one home configuration, wherein said panel (4) is outside said longitudinal channel (3) and said first corner (8) is moved away from said coupling plane (5); and at least one coupling configuration, wherein said panel (4) is inside said longitudinal channel (3) and said first corner (8) is approached to said coupling plane (5) and pressed to adhere hermetically to said panel (4);

wherein said seal element (6) comprises at least a second corner (17) adapted to adhere hermetically onto said profiled element (2) in said coupling configuration;

wherein said profiled element (2) comprises an arched shaped surface (19), said second corner (17) is adhered to said arched shape structure (19) during the displacement of said seal element (6) between said home configuration and said coupling configuration.

2. Profiled component (1) according to claim 1, wherein said seal element (6) comprises at least one axis of rotation (A) substantially parallel to said coupling plane (5), said axis of rotation (A) coinciding with a fulcrum (27) positioned between said lever edge (28) and said first corner (8) and around which at least part of said seal element (6) rotates between said home configuration and said coupling configuration.

3. Profiled component (1) according to claim 1, wherein said seal element (6) comprises at least a weakened portion (22) associated with said connection means (7), said weakened portion (22) being deformable to allow the displacement of said seal element (6) between said home configuration and said coupling configuration.

4. Profiled component (1) according to claim 1, wherein said seal element (6) comprises at least one sealing portion (23) associated with said connection means (7), said sealing portion (23) being deformable to seal at least partly said longitudinal channel (3) when said seal element (6) is in said coupling configuration.

5. Profiled component (1) according to claim 4, wherein said sealing portion (23) comprises at least one protrusion (25), said protrusion (25) winding at least partly said profiled element (2) outside said longitudinal channel (3) when said seal element (6) is in said coupling configuration.

6. Profiled component (1) according to claim 1, wherein said connection means (7) comprise at least one cavity (20) formed on at least one of said profiled element (2) and said seal element (6) and at least one interlocking portion (21) formed on the other of said profiled element (2) and said seal element (6) and fitted interlocked in said cavity (20).

7. Profiled component (1) according to claim 1, wherein said connection means (7) comprise at least one adhesive layer positioned between said seal element (6) and said profiled element (2).

8. Profiled component (1) according to claim 1, wherein said connection means (7) comprise at least a first extruded portion of said profiled element and at least a second extruded portion of said seal element (6), said first extruded portion and said second extruded portion being melted at least partly to each other.

9. Profiled component (1) according to claim 1, wherein said profiled component (1) comprises at least one shock absorber component (29) associated with said profiled element (2) inside said longitudinal channel (3), and adapted to receive and support said panel (4) inside said longitudinal channel (3) in said coupling configuration.

10. Frame (30), comprising:

at least one panel (4) of substantially sheet shape to surround at least partly; and a plurality of profiled components (1) according to claim 1;

wherein said panel (4) is surrounded at least partly by said profiled components (1) and said seal elements (6) of said profiled components (1) are in said coupling configuration.

* * * * *